US007219376B1

(12) United States Patent
Zhou

(10) Patent No.: US 7,219,376 B1
(45) Date of Patent: May 22, 2007

(54) AUTOMATIC ELEVATING SHOWER

(76) Inventor: Huasong Zhou, Rm 704, #135, Hubin S. Road, Xiamen, Fujian (CN)

( * ) Notice: Subject to any disclaimer, the term of this patent is extended or adjusted under 35 U.S.C. 154(b) by 0 days.

(21) Appl. No.: 11/419,198

(22) Filed: May 18, 2006

(51) Int. Cl.
*A47K 3/20* (2006.01)
*A47K 4/00* (2006.01)

(52) U.S. Cl. ..... 4/567; 4/570; 4/601; 4/605; 4/615; 239/280.5; 239/390

(58) Field of Classification Search ..... 4/567, 4/570, 596, 601, 605, 606, 615; 239/284.1, 239/280, 280.5, 281, 310, 390, 436, 752
See application file for complete search history.

(56) References Cited

U.S. PATENT DOCUMENTS 4,360,159 A * 11/1982 Haynes ..... 4/605
5,035,010 A * 7/1991 Sakamoto et al. ..... 4/567
6,256,808 B1 * 7/2001 Graham et al. ..... 4/615
6,626,378 B2 * 9/2003 Sasaki et al. ..... 239/310

* cited by examiner

*Primary Examiner*—Tuan Nguyen
(74) *Attorney, Agent, or Firm*—Banger Shia

(57) ABSTRACT

The present invention provides an automatic elevating shower, which is typically comprised of a main body including a shower head, an elevating rod, a sleeving, a switchgear and hoses, said main body is at least possessed of one elevating component; said shower head is connected to a stub pipe of the supply pipe via a T-joint; said sleeving is mounted on a relative static position vertically, and there are two ports such as upper and low ports built on the top and bottom ends, and a hollow cylindrical cavity built upon between said upper and low ports; said elevating component is mounted on said elevating rod vertically, which is fit into said cylindrical cavity of said sleeving via a piston fixed on the bottom end; said switchgear is possessed of four ports respectively connecting to the two ports of the sleeving, the third port of the T-joint connecting the shower head and another stub pipe of the supply pipe, so that shifting said switchgear can control the third port of the T-joint of the shower head connecting to the upper port of the sleeving, and the another stub pipe of the supply pipe connecting to the low port of the sleeving, or the third port of the T-joint connecting to the low port of the sleeving and the another stub pipe of the supply pipe connecting to the upper port of the sleeving, or all ports blocking in three stage switching. This structure facilitates to use with better showing effect.

5 Claims, 10 Drawing Sheets

AUTOMATIC ELEVATING SHOWER

BACKGROUND OF THE INVENTION

1. Field of the Invention

The present invention relates to a shower set, and more particularly to an automatic elevating shower.

2. Description of Prior Art

In accordance with the conventional technology, the most of the conventional showers have three spraying nozzles, like head, side and hand-hold nozzles. But after mounted on the wall, the head and side nozzles are unable to be adjusted in height, so as not to meet the necessary of different high users especially to super-elevation users, further to affecting the showering effect. If washing any portion of body, just only use hand-hold shower head, so that one head has to be occupied in operation, it is inconvenient to user, meanwhile the showering effect is also affected.

This is the sake of discovering the present invention.

OBJECTS AND SUMMARY OF THE INVENTION

It is therefore a main object of the present invention to provide an automatic elevating shower facilitating to use with good showering effect.

For achieving the above-mentioned object, the present invention provides an automatic elevating shower that is typically comprised of a main body including a shower head, an elevating rod, a sleeving, a switchgear and hoses, said main body is at least possessed of one elevating component; said shower head is connected to a stub pipe of the supply pipe via a T-joint; said sleeving is mounted on a relative static position vertically, and there are two ports such as upper and low ports built on the top and bottom ends, and a hollow cylindrical cavity built upon between said upper and low ports; said elevating component is mounted on said elevating rod vertically, which is fit into said cylindrical cavity of said sleeving via a piston fixed on the bottom end, so as to combine a hydraulic cylinder; said switchgear is possessed of four ports respectively connecting to the two ports of the sleeving, the third port of the T-joint connecting the shower head and another stub pipe of the supply pipe, so that shifting said switchgear can control the third port of the T-joint of the shower head connecting to the upper port of the sleeving, and the another stub pipe of the supply pipe connecting to the low port of the sleeving, or the third port of the T-joint connecting to the low port of the sleeving and the another stub pipe of the supply pipe connecting to the upper port of the sleeving, or all ports blocking in three stage switching.

Said shower head of said main body is the elevating component, which is hung on the elevating rod via a shower head holder; said sleeving is mounted on the main body vertically.

Said main body is the elevating component, there are at least two sleevings mounted on the wall parallelly and vertically, and they are connected into together parallelly leading out one upper port at top, and leading out a low port at bottom; the number of the elevating rods is as same as the number of the sleevings, said main body is mounted on the elevating rods vertically.

Said switchgear is a reversing valve, which is typically comprised of a valve body, a ceramic static core, a ceramic rotary core and a handle; said valve body is possessed of a hollow cavity and four joints, said four joints are respectively communicated to said hollow cavity to form four through-holes arranged in a ring distribution on the bottom side of the hollow cavity, in which the first joint is used to connect to another stub pipe of the supply pipe, the second joint to the upper port of the sleeving, the third joint to the third port of the T-joint of the shower head, the fourth joint to the low port of the sleeving; the ceramic static core located on the bottom of the hollow cavity is possessed of four holes coordinating to the four through-holes built upon the bottom side of the hollow cavity, such as from the first to fourth holes; said ceramic rotary core is lapped over said ceramic static core in the hollow cavity, and possessed of two curved switchover holes respectively coordinating to the positions of the second and the fourth holes of the ceramic static core; said handle is fixed on the ceramic rotary core with the inner end, by turning the outer handle, to bring the ceramic rotary core to relatively turning to the ceramic static core, so that the first switchover hole connects the first hole to the second hole, meanwhile the second switchover hole connects the third hole to the fourth hole, or the first switchover hole connects the second hole to the third hole, meanwhile the second switchover hole connects the first hole to the fourth hole, or all the holes of the ceramic static core are blocked, so three stage switching function is carried out.

Said sleeving is also possessed of a dog link built upon the inside of said cylindrical cavity, said elevating rod is fit over said dog link for preventing from turning relatively and affecting to elevating.

As utilizing above-mentioned project, when tending to use the present invention, as turning on water, the water is led into the shower head via the stub pipe of the supply pipe and the T-joint sequentially for spraying out, meanwhile another port of the T-joint and another stub pipe of the supply pipe, and the upper and low ports of the sleeving are connected on said switchgear for switching elevating. When tending to make the elevating component (such as shower head or the whole main body) goes up, turning the handle of the switchgear shifts the third port of said T-joint connecting to the upper port of the sleeving, meanwhile the stub pipe of the supply pipe connecting to the low port of the sleeving, in this case, due to the low pressure of the third port of the T-joint connecting to the shower head, the water pressure of the stab pipe of the supply pipe is evidently higher, so the pressure of the low port of the sleeving is higher than the upper port's, under the different pressure between the upper and low ports of the sleeving, the piston is pushed going up so as to lift the elevating rod up automatically, such as the shower head or the whole main body is lifted up automatically. When tending to make the elevating component (such as shower head or the whole main body) goes down, turning the handle of the switchgear shifts the stub pipe of the supply pipe connecting to the upper port of the sleeving, meanwhile the third port of said T-joint connecting to the low port of the sleeving, in this case, due to the low pressure of the third port of the T-joint connecting to the shower head, the water pressure of the stab pipe of the supply pipe is evidently higher, so the pressure of the upper port of the sleeving is higher than the low port's, under the different pressure between the upper and low ports of the sleeving, the piston is pushed going down so as to bring the elevating rod to going down automatically, such as the shower head or the whole main body is dropped down automatically. When the shower head or the whole of the main body gets the desired position in proper high, turning the switchgear shifts to close all ports of the sleeving, so as to eliminate all extra water pressure exerting on the upper and low ports of the sleeving, the piston is kept on the desired position, so the elevating rod is stopped lifting up or dropping down to be located on the place to carry out locating function.

Thus it can be seen that by means of dividing water pipe and switching water lines, the hydraulic cylinder comprised of the elevating rod including piston and sleeving of the present invention can carry out automatically elevating function, so as to automatically adjust the spraying height for facilitating to use and getting better showing effect. Additionally, because the present invention offers an elevating system, the hand-hold shower head hung over it can be lifted on the top working as a top nozzle, so the present invention substitutes the hand-hold shower head for the conventional top nozzle, so one hand-hold shower head works as two nozzles, hence the production cost can be decreased.

DETAILED DESCRIPTION OF PREFERRED EMBODIMENTS

Figure 1:
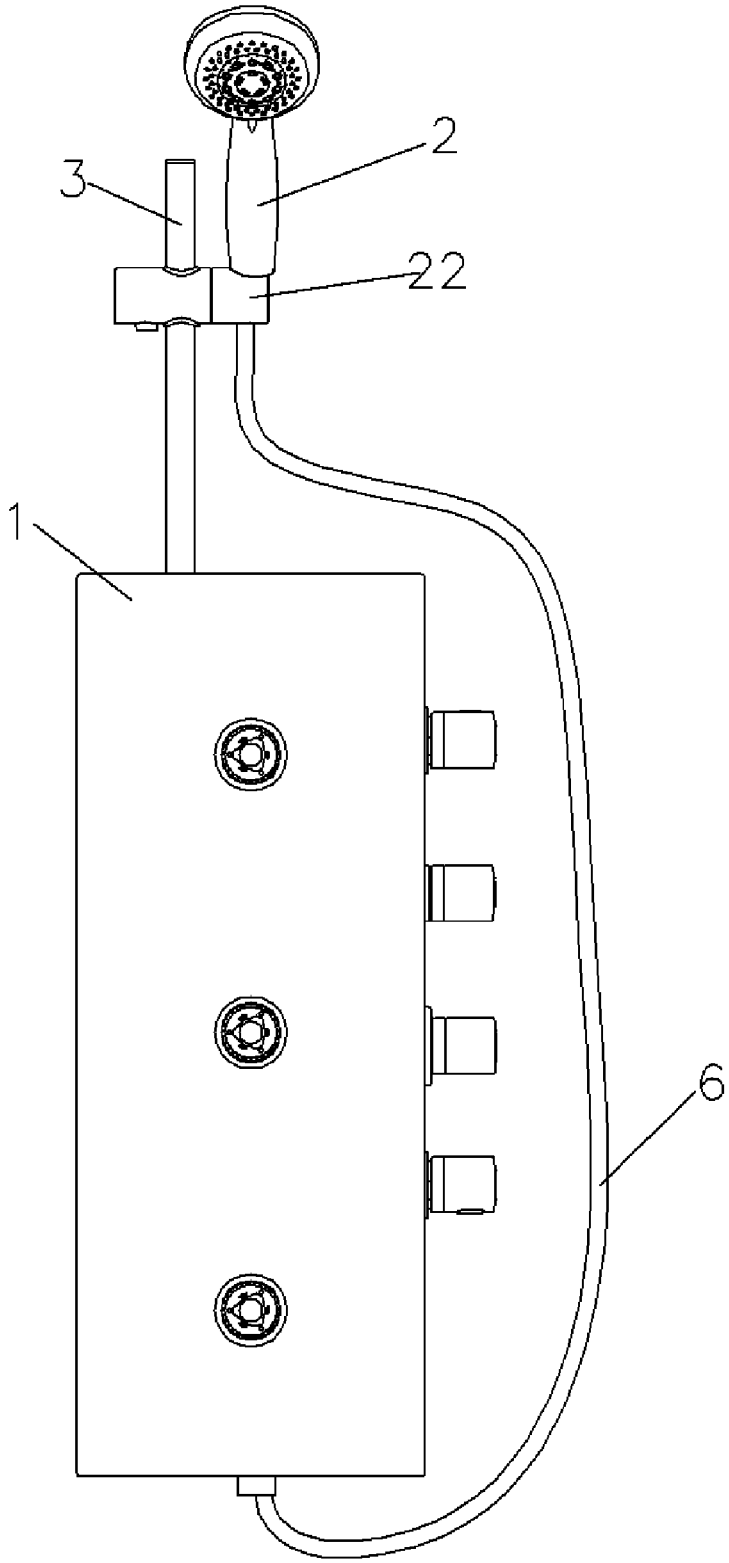
FIG. 1 is a front side view showing the first embodiment (the shower head is the elevating component) of the present invention.
Figure 2:
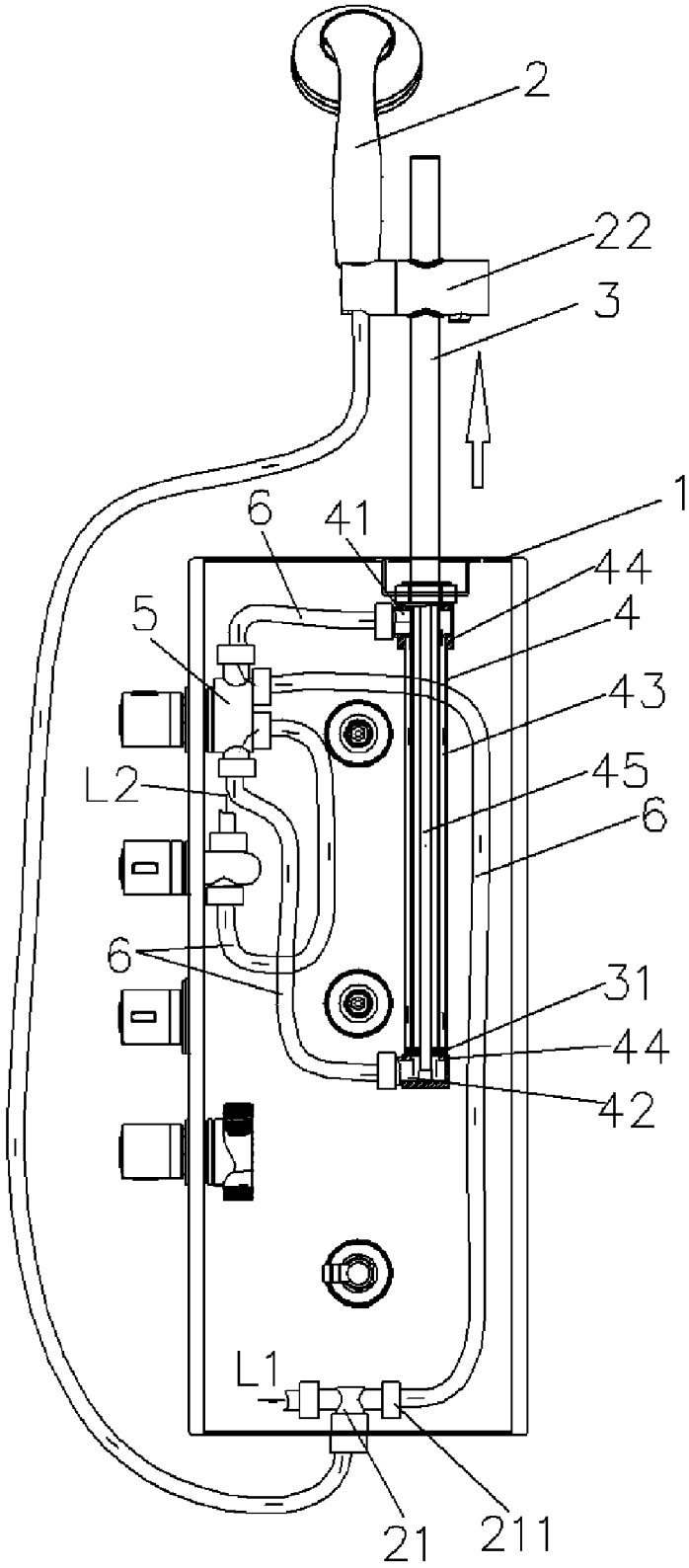
FIG. 2 is a cross-section view showing the lifting state of FIG. 1.

Referring to FIG. 1 and FIG. 2, an automatic elevating shower discovered by the present invention is typically comprised of a main body 1 including a shower head 2, an elevating rod 3, a sleeving 4, switchgear 5 and hoses 6. Certainly, some side nozzles and so on can be equipped on, but this is not related with the present invention, so not to be described.

Wherein, said main body 1 is at least possessed of one elevating component, in this embodiment, said elevating component is a shower head 2, which is connected to a stub pipe L1 of the supply pipe (not shown in drawings) via a T-joint 21. The third port 211 of said T-joint 21 is attached with a hose 6. Said shower head 2 is hung on the elevating rod 3 via a shower head holder 22.

Said sleeving 4 is mounted on a relative static position vertically, in this embodiment, said main body 1 is relative static object. There are two ports such as upper and low ports 41 42 built on the top and bottom ends of the sleeving 4 respectively via two end blocks 44, between the both end blocks 44 there is a hollow cylindrical cavity 43 formed. Said upper and low ports 41 42 can also be connected to the sleeving 4 in other way, not limited in this way of using end blocks 44.

Said elevating rod 3 is fit into said cylindrical cavity 43 of said sleeving 4 via a piston 31 fixed on the bottom end, so as to construct a hydraulic cylinder. For preventing the elevating rod 3 from turning in the sleeving 4 and affecting elevating motion, said sleeving 4 is also possessed of a dog link 45 built upon the inside of said cylindrical cavity 43, said elevating rod 3 is fit over said dog link 45.

Said switchgear 5 can be selected in many way in structures, it can be one or more reversing valves integrated together, in working principle, the upper and low ports 41 42 of the sleeving 4, the third port 211 of the T-joint 21 connecting to the shower head 2 and another stub pipe L2 of the supply pipe are connected to the integrated reversing valve 5, thereby carrying out controlling the third port 211 connecting to the upper port 41, meanwhile the stub pipe L2 connecting to the low port 42, or the third port 211 connecting to the low port 42, meanwhile the stub pipe L2 connecting to the upper port 41, or all ports are blocked, so three stage switching function is carried out.

Figure 7:
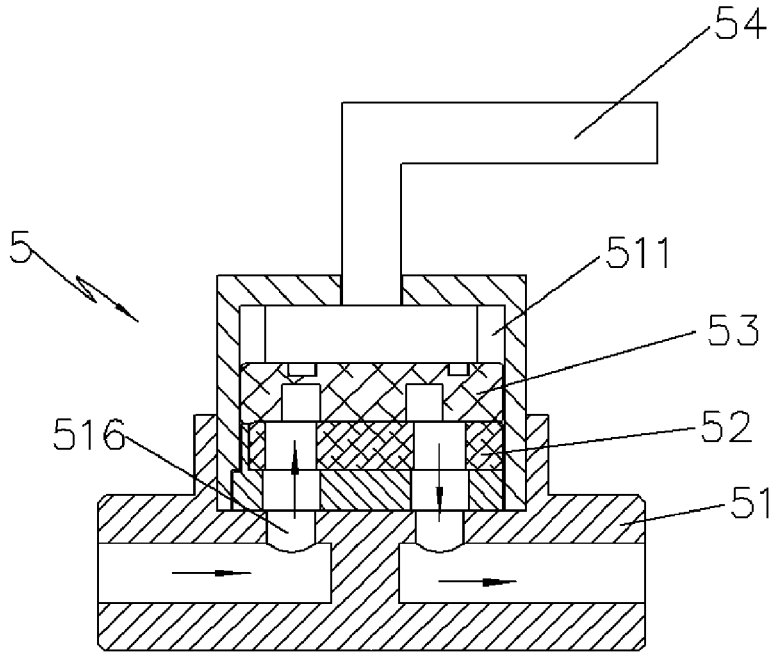
FIG. 7 is a cross-section view showing the switchgear of the present invention.

In this embodiment, the present invention provides the switchgear 5 that actually is a reversing valve, as shown in FIG. 7, which is typically comprised of a valve body 51, a ceramic static core 52, a ceramic rotary core 53 and a handle 54.

Figure 8:
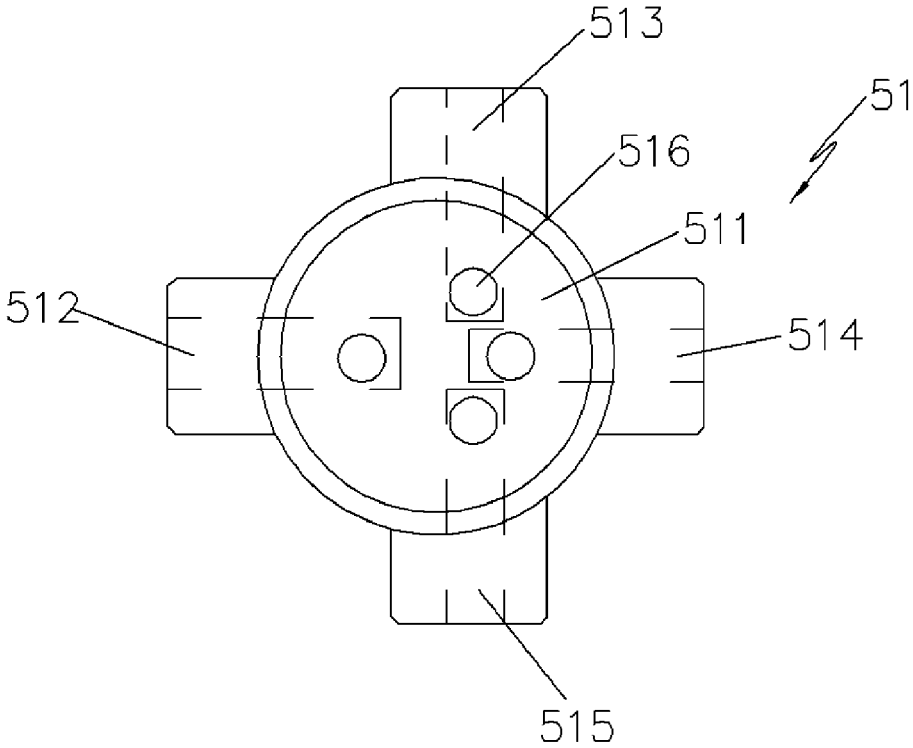
FIG. 8 is a top side view showing the switchgear of the present invention.

Said valve body 51 illustrated in FIG. 8 is possessed of a hollow cavity 511 and four joints 512 to 515, said four joints 512 to 515 are respectively communicated to said hollow cavity 511 to form four through-holes 516 arranged in a ring distribution on the bottom side of the hollow cavity 511, in which the first joint 512 is used to connect to another stub pipe L2 of the supply pipe, the second joint 513 to the upper port 41 of the sleeving 4, the third joint 514 to the third port 211 of the T-joint 21 of the shower head 2, the fourth joint 515 to the low port 42 of the sleeving 4.

Figure 9:
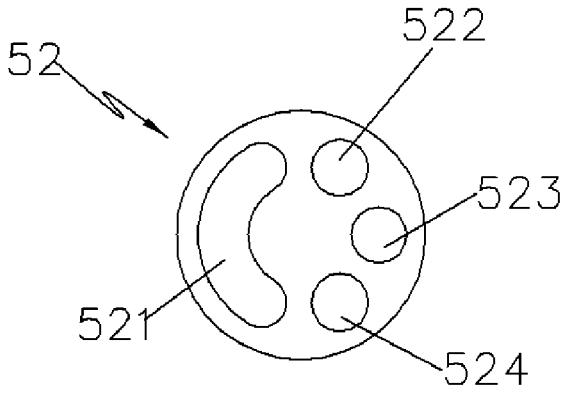
FIG. 9 is a top side view showing the ceramic static core of the present invention.

The ceramic static core 52 located on the bottom of the hollow cavity 511, as shown in FIG. 9, is possessed of four holes coordinating to the four through-holes 516 built upon the bottom side of the hollow cavity, such as from the first to fourth holes 521 to 524.

Figure 10:
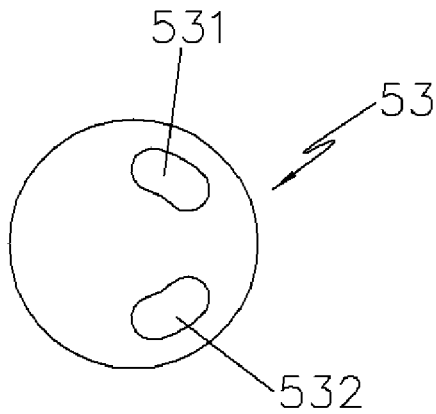
FIG. 10 is a bottom side view showing the ceramic rotary core of the present invention.

Said ceramic rotary core 53 illustrated in FIG. 10 is lapped over said ceramic static core 52 in the hollow cavity 511, and possessed of two curved switchover holes 531 532 respectively coordinating to the positions of the second and the fourth holes 533 and 534 of the ceramic static core 52.

Said handle 54 is fixed on the ceramic rotary core 53.

The working principles of the first embodiment and the switchgear are illustrated in FIG. 2 and FIG. 3, and FIG. 11 to FIG. 13.

When tending to use the present invention, as turning on water, the water is led into the shower head 2 via the stub pipe L1 of the supply pipe and the T-joint 21 sequentially for spraying out, meanwhile the third port 211 of the T-joint 21 and another stub pipe L2 of the supply pipe, and the upper and low ports 41 42 of the sleeving 4 are connected on said switchgear 5 for shifting elevating function by turning the switchgear 5.

Figure 11:
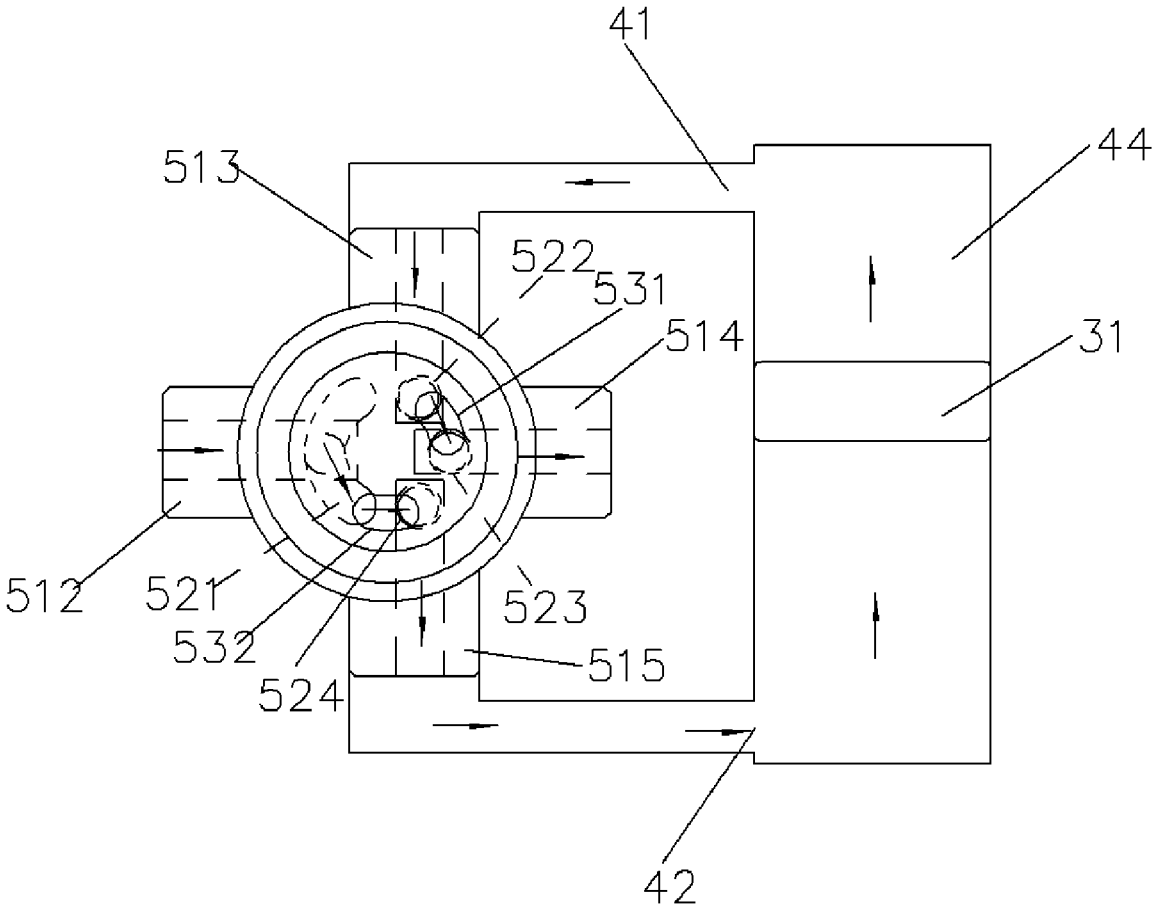
FIG. 11 is a scheme showing the working principle of the switchgear in lifting up state of the present invention.

When tending to make the shower head 2 go up, turning the handle 54 rotates the ceramic rotary core 53 relative to the ceramic static core 52, as shown in FIG. 2 and FIG. 11, so that the first switchover hole 531 connect the second hole 522 to the third hole 523, such as connects the third port 211 of said T-joint 21 to the upper port 41 of the sleeving 4, meanwhile the second switchover hole 532 connects the first hole 521 to the fourth hole 524, such as connects the stub pipe L2 of the supply pipe connecting to the low port 42 of the sleeving 4, in this case, due to the low pressure of the third port 211 of the T-joint 21 connecting to the shower head 2, the water pressure of the stab pipe L2 of the supply pipe is evidently higher, so the pressure of the low port 42 of the sleeving 4 is higher than the upper port's, under the different pressure between the upper and low ports 41 42 of the sleeving 4, the piston 31 is pushed going up so as to lift the elevating rod 3 up automatically, such as the shower head 2 is lifted up automatically. The water in the upper portion of the cylindrical cavity 43 is pushed out by the moving piston 31, passing through the upper port 41, the second hole 522, the third hole 523, the hose 6, the third port 211, finally via the T-joint 21 to be sprayed out from the shower head 2.

Figure 3:
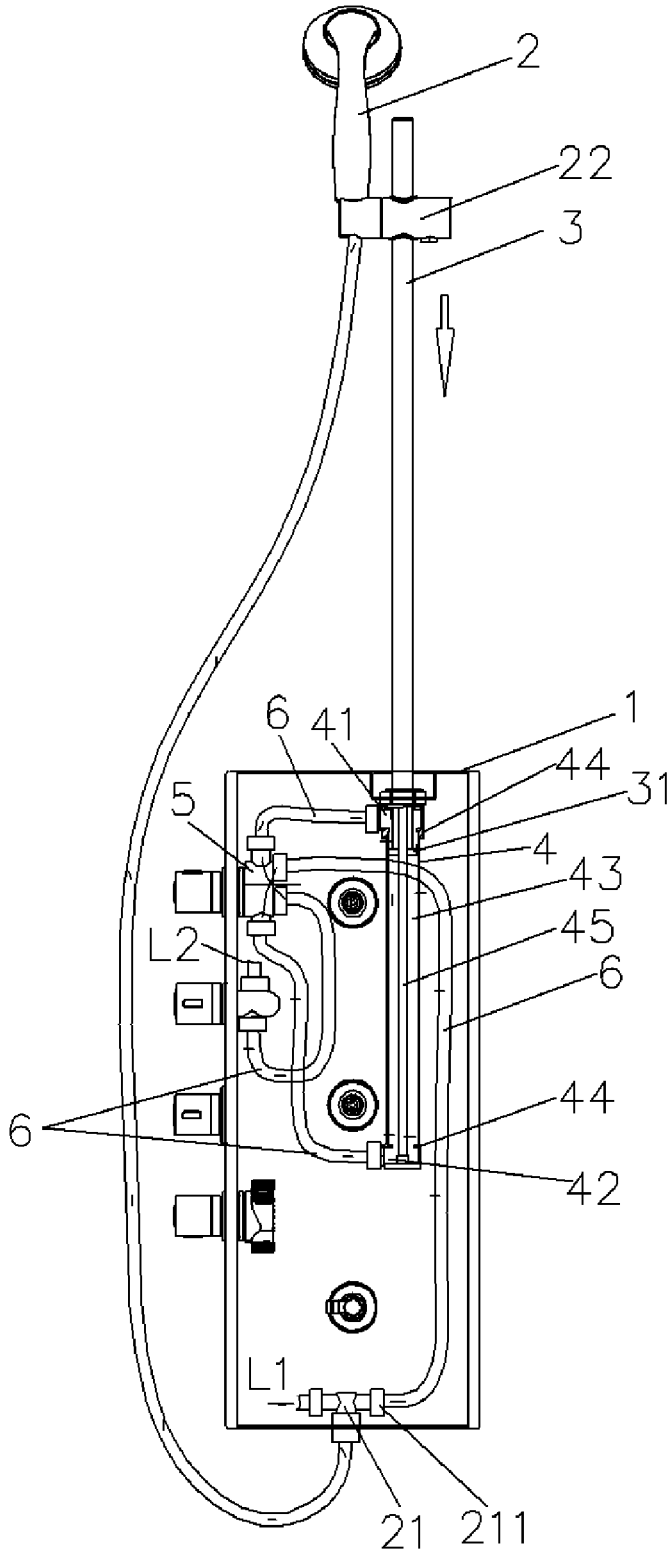
FIG. 3 is a cross-section view showing the dropping down state of FIG. 1.
Figure 12:
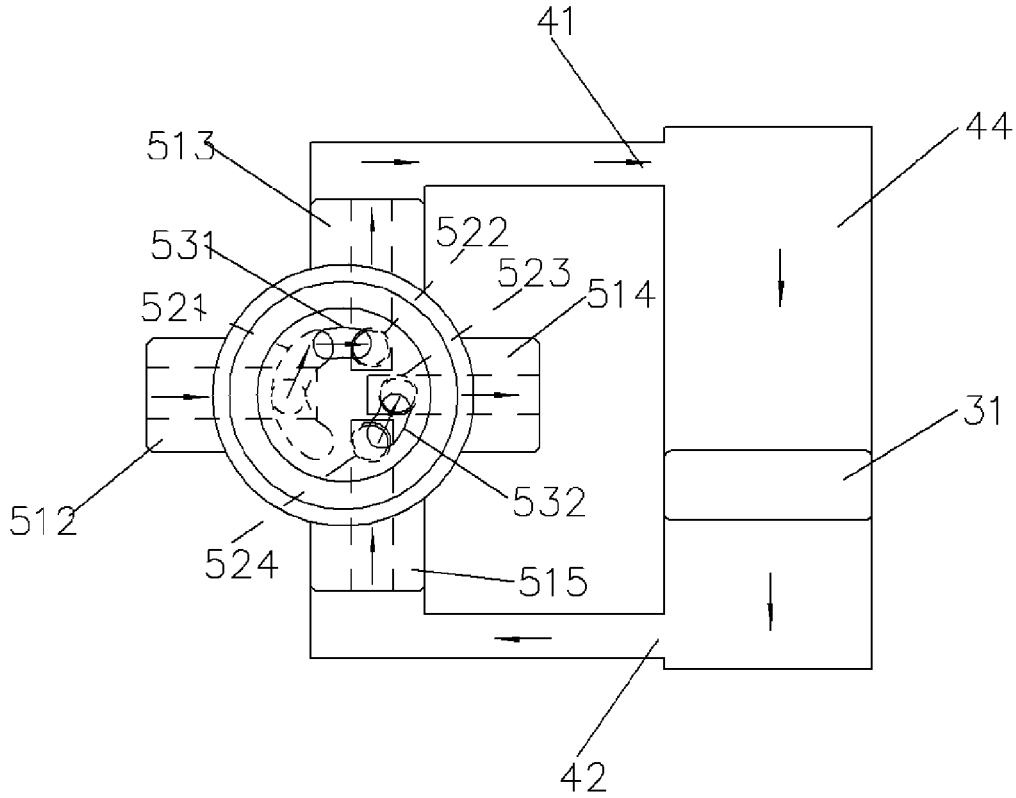
FIG. 12 is a scheme showing the working principle of the switchgear in falling down state of the present invention.

When tending to make the shower head 2 go down, turning the handle 54 rotates the ceramic rotary core 53 relative to the ceramic static core 52, as shown in FIG. 3 and FIG. 12, so that the first switchover hole 531 connects the first hole 521 to the second hole 522, such as connects the stub pipe L2 of the supply pipe to the upper port 41 of the sleeving 4, meanwhile the second switchover hole 532 connects the third hole 523 to the fourth hole 524, such as connect the third port 211 of said T-joint 21 to the low port 42 of the sleeving 4, in this case, due to the low pressure of the third port 211 of the T-joint 21 connecting to the shower head 2, the water pressure of the stab pipe L2 of the supply pipe is evidently higher, so the pressure of the upper port 42 of the sleeving 4 is higher than the low port's, under the different pressure between the upper and low ports 41 42 of the sleeving 4, the piston 31 is pushed going down so as to bring the elevating rod 3 to going down automatically, such as the shower head 2 is dropped down automatically. The water in the low portion of the cylindrical cavity 43 is pushed out by the moving piston 31, passing through the low port 42, the fourth hole 524, the third hole 523, the hose 6, the third port 211, finally via the T-joint 21 to be sprayed out from the shower head 2.

Figure 13:
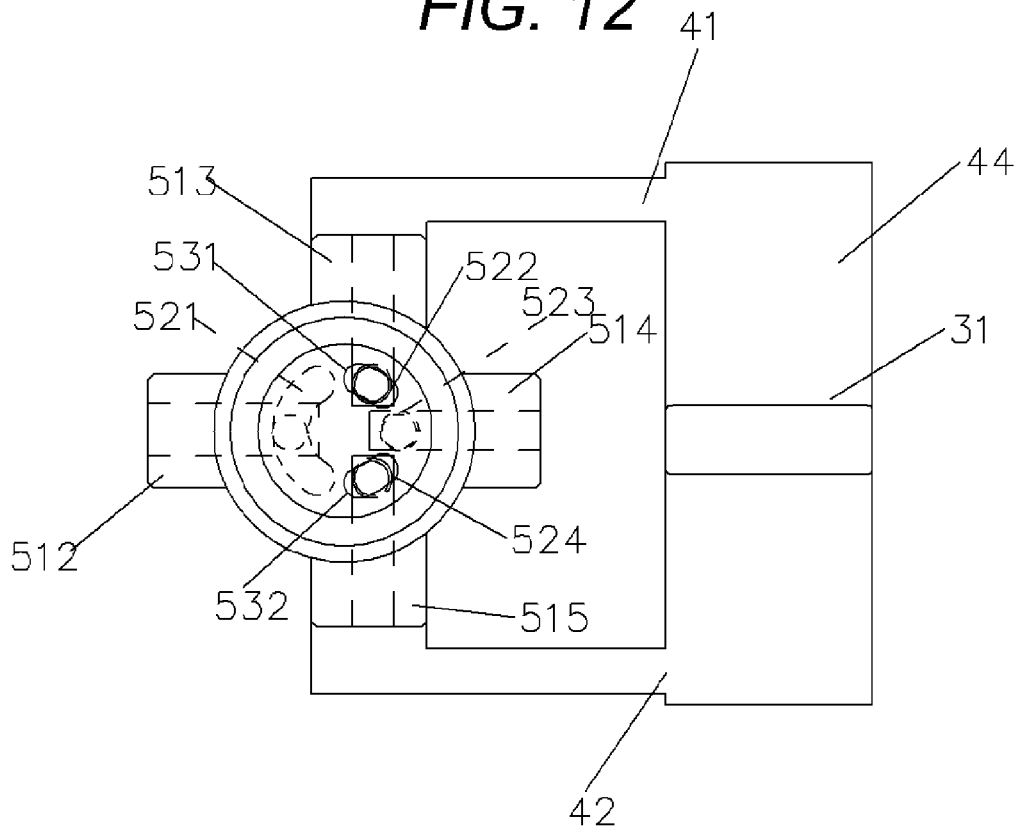
FIG. 13 is a scheme showing the working principle of the switchgear in locating state of the present invention.

When the shower head 2 gets the desired position in proper high, turning the switchgear 54 rotates the ceramic rotary core 53 relative to the ceramic static core 52, as shown in FIG. 13, so that the first switchover hole 531 of the ceramic rotary core 53 moves on the second hole 522 only, meanwhile the second switchover hole 532 locates on the fourth hole 524 without communicating to other holes, to close all ports of the sleeving 4, such as to eliminate all extra water pressure exerting on the upper and low ports 41 42 of the sleeving 4, the piston 31 is kept on the desired position, so the elevating rod 3 is stopped lifting up or dropping down to be located on the place to carry out locating function.

Figure 4:
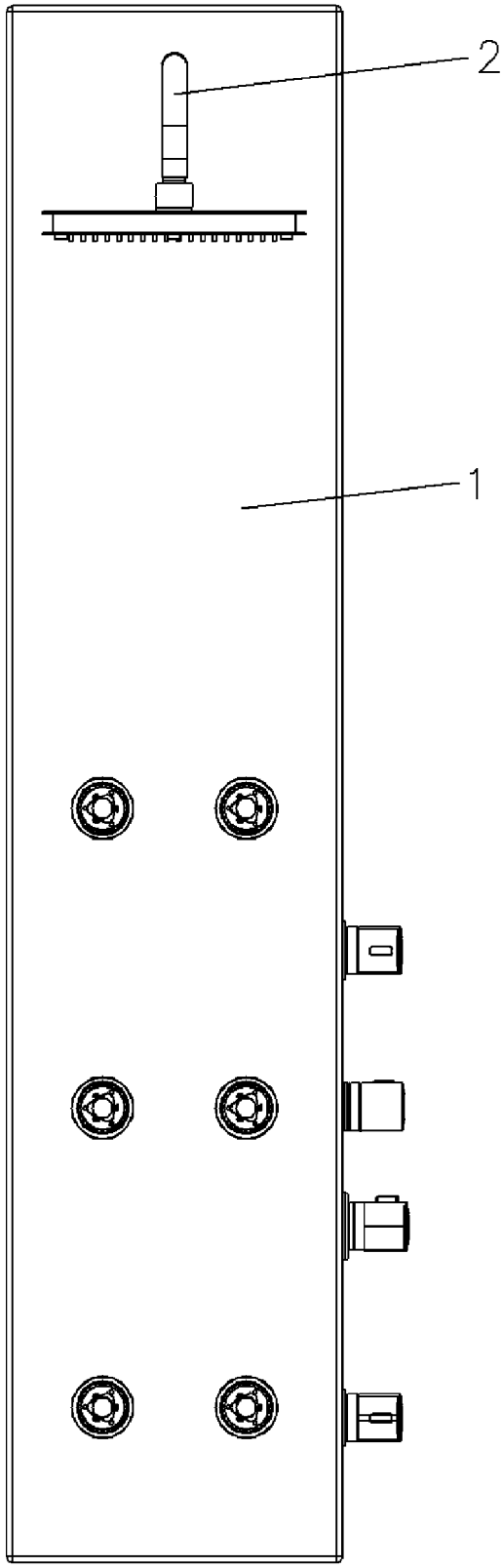
FIG. 4 is a front side view showing the second embodiment (the whole main body is the elevating component) of the present invention.
Figure 4A:
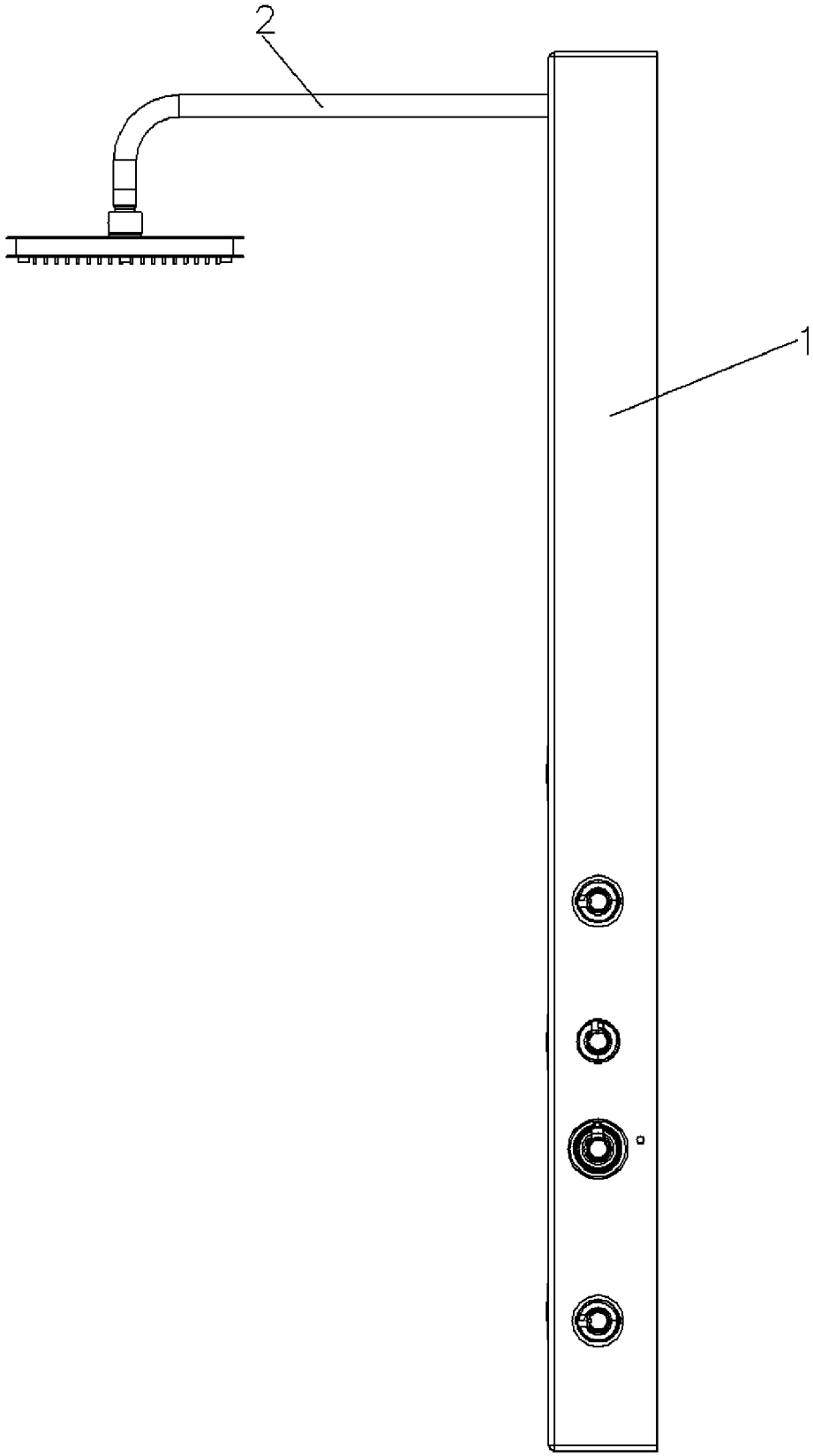
FIG. 4*a* is a left side view of FIG. 4.
Figure 5:
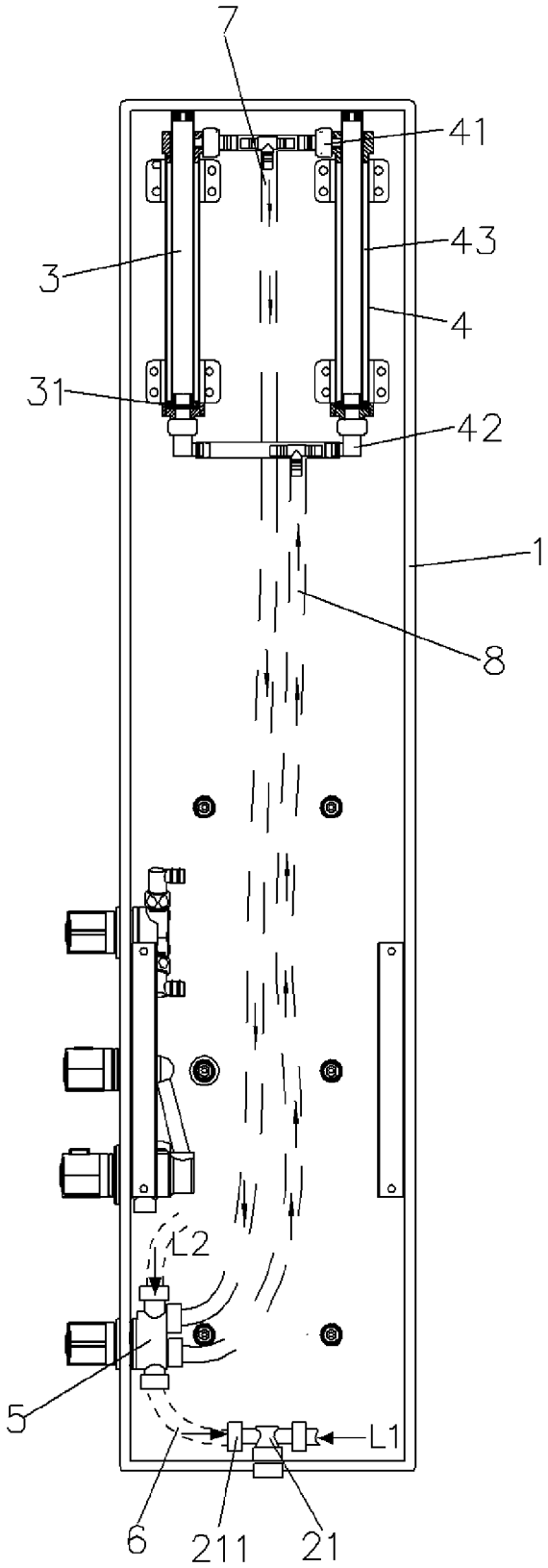
FIG. 5 is a cross-section view showing the falling down state of FIG. 4.
Figure 6:
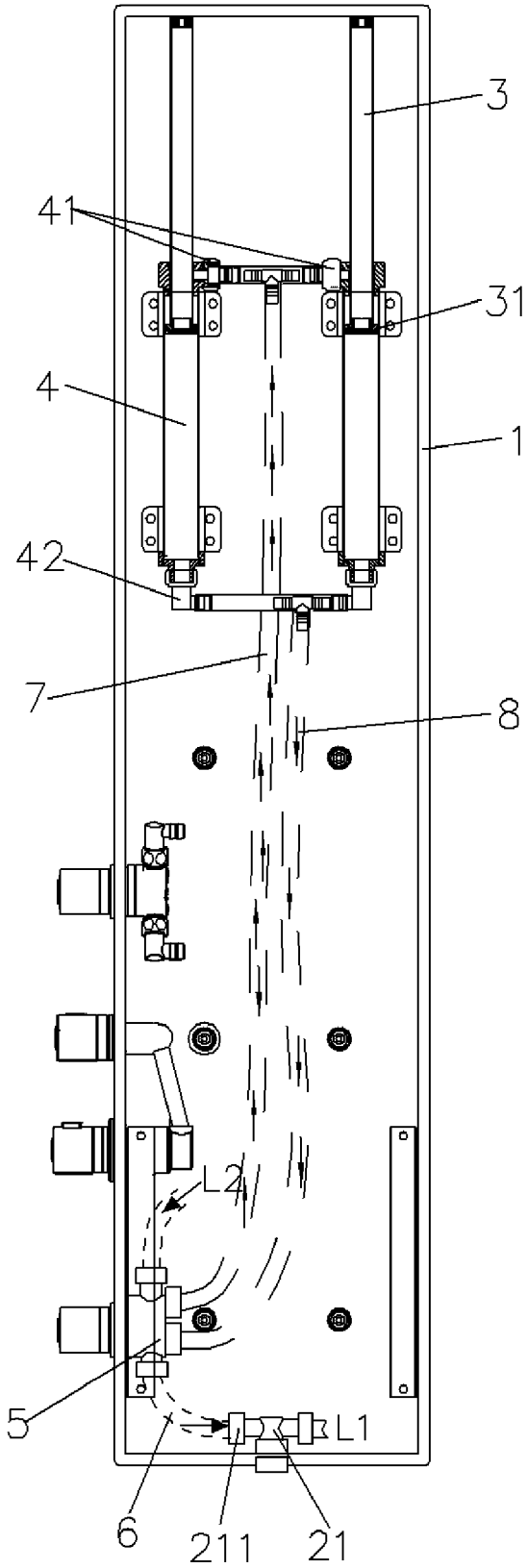
FIG. 6 is a cross-section view showing the lifting up state of FIG. 4.

The second embodiment of the present invention illustrated in FIG. 4 to FIG. 6 is typically comprised of a main body 1 including a shower head 2, elevating rods 3, sleevings 4, switchgear 5 and hoses 6 7 8. Certainly, some side nozzles and so on can be equipped on, but this is not related with the present invention, so not to be described.

Wherein, said main body 1 is at least possessed of one elevating component, in the second embodiment, said elevating component is the whole main body 1.

Said shower head 2 is connected to a stub pipe L1 of the supply pipe (not shown in drawings) via a T-joint 21. The third port 211 of said T-joint 21 is attached with a hose 6.

Said sleevings 4 are mounted on a relative static position vertically, in the second embodiment, said sleevings 4 are located on the wall directly, parallelly and vertically. For keeping the main body 1 to move smoothly, there are at least two parallel sleevings 4 employed in second embodiment, the number of the sleevings 4 is not limited, but two is the prefer in this embodiment. There are two ports such as upper and low ports 41 42 built on the top and bottom ends of each sleeving 4 respectively. Between the upper and low ports 41 42 of the sleeving there is a hollow cylindrical cavity 43 formed for containing the elevating rod 3. All the upper ports 41 of the sleevings 4 are connected together by a hose 7 integrated to lead out an upper port at top, in the same way, a low port led out with a hose 8 at bottom.

Said whole main body 1 is mounted on the tip ends of the elevating rods 3 vertically, the number of the elevating rods 3 is as same as the number of the sleevings 4. Said each elevating rod 3 is attached with a piston 31 at the bottom end, and said piston 31 is fit into inside of the cylindrical cavity 43 of the sleeving 4 air-tightly.

Said switchgear 5 can be selected in many way in structures, it can be one or more reversing valves integrated together, in working principle, the hose 7 led out from common upper ports 41 of the parallel sleevings 4 and the hose 8 led out from common low ports 42 of the parallel sleevings 4, the third port 211 of the T-joint 21 connecting to the shower head 2 and another stub pipe L2 of the supply pipe are connected to the integrated reversing valve 5, thereby carrying out controlling the third port 211 connecting to the upper port 41, meanwhile the stub pipe L2 connecting to the low port 42, or the third port 211 connecting to the low port 42, meanwhile the stub pipe L2 connecting to the upper port 41, or all ports are blocked, so three stage switching function is carried out.

In the second embodiment, the present invention provides the switchgear 5 that actually is a reversing valve as same as in the first embodiment, as shown in FIG. 7, which is typically comprised of a valve body 51, a ceramic static core 52, a ceramic rotary core 53 and a handle 54. Wherein, the structure of said valve body 51 is illustrated in FIG. 8; the structure of the ceramic static core 52 is illustrated in FIG. 9; the structure of the ceramic rotary core 53 is illustrated in FIG. 10.

The working principles of the second embodiment and the switchgear are illustrated in FIG. 4 and FIG. 6, and FIG. 11 to FIG. 13.

When tending to use the present invention, as turning on water, the water is led into the shower head 2 via the stub pipe L1 of the supply pipe and the T-joint 21 sequentially for spraying out, meanwhile the third port 211 of the T-joint 21 and another stub pipe L2 of the supply pipe, and the upper and low ports 41 42 of the sleeving 4 are connected on said switchgear 5 for shifting elevating function by turning the switchgear 5.

When tending to make the whole main body 1 go up, turning the handle 54 rotates the ceramic rotary core 53 relative to the ceramic static core 52, as shown in FIG. 5 and FIG. 11, so that the first switchover hole 531 connect the second hole 522 to the third hole 523, such as connects the third port 211 of said T-joint 21 to the hose 7, meanwhile the second switchover hole 532 connects the first hole 521 to the fourth hole 524, such as connects the stub pipe L2 of the supply pipe connecting to the hose 8, in this case, due to the low pressure of the third port 211 of the T-joint 21 connecting to the shower head 2, the water pressure of the stab pipe L2 of the supply pipe is evidently higher, so the pressure of the hose 8 is higher than the upper port's, under the different pressure between the upper and low ports 41 42 of each sleeving 4, the piston 31 is pushed going up so as to lift the elevating rod 3 up automatically, such as the shower head 2 is lifted up automatically. The water in the upper portion of the cylindrical cavity 43 is pushed out by the moving piston 31, passing through the upper port 41, the hose 7, the second hole 522, the third hole 523, the hose 6, the third port 211, finally via the T-joint 21 to be sprayed out from the shower head 2.

When tending to make the whole main body 1 go down, turning the handle 54 rotates the ceramic rotary core 53 relative to the ceramic static core 52, as shown in FIG. 6 and FIG. 12, so that the first switchover hole 531 connects the first hole 521 to the second hole 522, such as connects the stub pipe L2 of the supply pipe to the hose 7, meanwhile the second switchover hole 532 connects the third hole 523 to the fourth hole 524, such as connect the third port 211 of said T-joint 21 to the hose 8, in this case, due to the low pressure of the third port 211 of the T-joint 21 connecting to the shower head 2, the water pressure of the stab pipe L2 of the supply pipe is evidently higher, so the pressure of the upper port 42 of the each sleeving 4 is higher than the low port's, under the different pressure between the upper and low ports 41 42 of the sleeving 4, the piston 31 is pushed going down so as to bring the elevating rod 3 to going down automatically, such as the shower head 2 is dropped down automatically. The water in the low portion of the cylindrical cavity 43 is pushed out by the moving piston 31, passing through the low port 42, the hose 8, the fourth hole 524, the third hole 523, the hose 6, the third port 211, finally via the T-joint 21 to be sprayed out from the shower head 2.

When the shower head 2 gets the desired position in proper high, turning the switchgear 54 rotates the ceramic rotary core 53 relative to the ceramic static core 52, as shown in FIG. 13, so that the first switchover hole 531 of the ceramic rotary core 53 moves on the second hole 522 only, meanwhile the second switchover hole 532 locates on the fourth hole 524 without communicating to other holes, to close all ports of the sleeving 4, such as to eliminate all extra water pressure exerting on the upper and low ports 41 42 of the sleeving 4, the piston 31 is kept on the desired position, so the elevating rod 3 is stopped lifting up or dropping down to be located on the place to carry out locating function.

I claim:

1. An automatic elevating shower typically comprised of a main body including a shower head, an elevating rod, a sleeving, a switchgear and hoses, said main body is at least possessed of one elevating component; said shower head is connected to a stub pipe of the supply pipe via a T-joint; said sleeving is mounted on a relative static position vertically, and there are two ports such as upper and low ports built on the top and bottom ends, and a hollow cylindrical cavity built upon between said upper and low ports; said elevating component is mounted on said elevating rod vertically, which is fit into said cylindrical cavity of said sleeving via a piston fixed on the bottom end, so as to combine a hydraulic cylinder; said switchgear is possessed of four ports respectively connecting to the two ports of the sleeving, the third port of the T-joint connecting the shower head and another stub pipe of the supply pipe, so that shifting said switchgear can control the third port of the T-joint of the shower head connecting to the upper port of the sleeving, and the another stub pipe of the supply pipe connecting to the low port of the sleeving, or the third port of the T-joint connecting to the low port of the sleeving and the another stub pipe of the supply pipe connecting to the upper port of the sleeving, or all ports blocking in three stage switching.

2. An automatic elevating shower as claimed in claim 1, wherein said shower head of said main body is the elevating component, which is hung on the elevating rod via a shower head holder; said sleeving is mounted on the main body vertically.

3. An automatic elevating shower as claimed in claim 1, wherein said main body is the elevating component, there are at least two sleevings mounted on the wall parallelly and vertically, and they are connected into together parallelly leading out one upper port at top, and leading out a low port at bottom; the number of the elevating rods is as same as the number of the sleevings, said main body is mounted on the elevating rods vertically.

4. An automatic elevating shower as claimed in claim 1, wherein said switchgear is a reversing valve, which is typically comprised of a valve body, a ceramic static core, a ceramic rotary core and a handle; said valve body is possessed of a hollow cavity and four joints, said four joints are respectively communicated to said hollow cavity to form four through-holes arranged in a ring distribution on the bottom side of the hollow cavity, in which the first joint is used to connect to another stub pipe of the supply pipe, the second joint to the upper port of the sleeving, the third joint to the third port of the T-joint of the shower head, the fourth joint to the low port of the sleeving; the ceramic static core located on the bottom of the hollow cavity is possessed of four holes coordinating to the four through-holes built upon the bottom side of the hollow cavity, such as from the first to fourth holes; said ceramic rotary core is lapped over said ceramic static core in the hollow cavity, and possessed of two curved switchover holes respectively coordinating to the positions of the second and the fourth holes of the ceramic static core; said handle is fixed on the ceramic rotary core with the inner end, by turning the outer handle, to bring the ceramic rotary core to relatively turning to the ceramic static core, so that the first switchover hole connects the first hole to the second hole, meanwhile the second switchover hole connects the third hole to the fourth hole, or the first switchover hole connects the second hole to the third hole, meanwhile the second switchover hole connects the first hole to the fourth hole, or all the holes of the ceramic static core are blocked, so three stage switching function is carried out.

5. An automatic elevating shower as claimed in claim 1, wherein said sleeving is also possessed of a dog link built upon the inside of said cylindrical cavity, said elevating rod is fit over said dog link for preventing from turning relatively and affecting to elevating.

* * * * *